US005901581A

United States Patent [19]

Chen et al.

[11] Patent Number: 5,901,581

[45] Date of Patent: May 11, 1999

[54] PARALYTIC LOWER LIMB REHABILITATION APPARATUS

[75] Inventors: Jia-Wine Chen; Ann-Shing Chang; Yeu-Shuun Kou, all of Taipei Hsien, Taiwan

[73] Assignee: Oriental Institute of Technology, Taipei Hsien, Taiwan

[21] Appl. No.: 09/092,541

[22] Filed: Jun. 5, 1998

[30] Foreign Application Priority Data

Jun. 7, 1997 [CN] China ..... 86209397

[51] Int. Cl.[6] ..... A61H 1/02

[52] U.S. Cl. ..... 64/34; 601/5; 601/33

[58] Field of Search ..... 601/5, 23, 24, 601/26, 33–35, 89, 90, 93, 97, 98, 101; 602/32–36

[56] References Cited

U.S. PATENT DOCUMENTS

| | | | |
|---|---|---|---|
| 4,549,534 | 10/1985 | Zagorski et al. | 601/33 |
| 4,834,073 | 5/1989 | Bledsoe et al. | 601/33 |

FOREIGN PATENT DOCUMENTS

| | | | |
|---|---|---|---|
| 190086 | 8/1986 | European Pat. Off. | 601/34 |
| 535513 | 4/1993 | European Pat. Off. | 601/33 |
| 2015054 | 10/1971 | Germany | 601/33 |
| 640740 | 1/1979 | U.S.S.R. | 601/34 |

*Primary Examiner*—Jeanne M. Clark
*Attorney, Agent, or Firm*—Merchant, Gould, Smith, Edell, Welter & Schmidt

[57] ABSTRACT

The present invention is related to a rehabilitation apparatus to alleviate the stiffness for patients suffering from lower limb paralysis caused by acute cerebral vascular impairment or vertebra impairment. The essential mechanisms of the rehabilitation apparatus include a transversely movable slider mechanism which makes use of a transverse slider capable of moving in a predetermined direction and for a predetermined distance to provide the thigh with reciprocal motion of inward retraction and outward expansion by means of a spherical joint which drives the rotation of a longitudinal slide rail, the outward expansion or inward retraction having an angular range between 0°–35°; a thigh supporting/moving mechanism which is suitable for a thigh length of 20–60 cm is adjustable and is free to slide when the hip joint is rotated so as to eliminate the upward pulling force and downward pressing force acting upon the thigh, thus reducing the risk of a second injury; and a sole supporting/moving mechanism wherein the support for the sole has slide rails which are inclined within the range of 12°–18° and therefore suitable for patients of different shank lengths. When the hip joint is rotated upward, the sole that is held on a holder causes the ankle joint to rotate inward, the rotating angle being up to 5°–15°.

7 Claims, 8 Drawing Sheets

PARALYTIC LOWER LIMB REHABILITATION APPARATUS

BACKGROUND OF THE INVENTION

Acute cerebral vascular impairment (usually referred to as a cerebral vascular accident) and vertebra impairment usually cause lower limb paralysis. The paralysis of a lower limb usually leads to joint stiffness and muscle atrophy at the hip joint, knee joint and ankle joint due to the lack of passive joint motion, which may even cause bed sores if the patient has been lying down in bed for a very long time. Thus, it is desirable to provide proper physical rehabilitation before the situation becomes worse.

However, due to the lack of rehabilitation personnel, most patients are not given sufficient rehabilitation treatment. As a consequence their lower limbs may be disabled and the patient may no longer be able to adapt himself or herself to his/her family and social life. This will give the patient's family and society in general heavy burden.

The current mechanical rehabilitation device performs only simple bending and extension/retraction exercises for the lower limb. It is not able to facilitate rotation motion for the hip joint, the knee joint and the ankle joint. Thus, as the muscle and joint of the patient's lower limb may not be fully exercised, and the function may be getting worse, the effectiveness of the conventional rehabilitation devices is very limited. Thus, the conventional rehabilitation device can not replace manual rehabilitation effectively.

Due to the above reasons, it is desirable to have a rehabilitation apparatus that possesses full rehabilitation function in order to replace manual rehabilitation. By using mechanical means to replace manual rehabilitation in performing periodic and regular exercise on the above-mentioned joints will reduce the occurrence of bed sores and muscle atrophy and will thus be of great help to the patient and his or her family.

SUMMARY OF THE INVENTION

The present invention is related to a rehabilitation apparatus which provides multiple degrees of freedom of motion to assist the paralytic lower limb of a patient having cerebral vascular impairment or vertebra impairment to perform exercise of more degrees of freedom so as to facilitate the rehabilitation of said lower limb. This invention at best, helps the recovery of the limb and, at worst, prevents the condition of the limb from getting worse.

The rehabilitation apparatus of the present invention utilizes electricity as a power source to drive the sliding mechanism for performing mechanical displacement to generate a three dimensional motion, the range and speed of which are adjustable, and which helps the hip joint, knee joint and ankle joint of the patient perform passive exercise in the upward and downward directions and the inward and outward directions at proper periods and with proper loads.

The rehabilitation apparatus of the present invention comprises: a transversely movable slider mechanism, a thigh supporting/moving mechanism and a sole supporting/moving mechanism; wherein the transversely movable slider mechanism makes use of a transversely movable slider which incorporates a spherical joint so that it generates a rotational motion to provide clockwise and counter-clockwise rotation of the patient's limb; the thigh supporting/moving mechanism supports the thigh and makes use of a thigh slider to allow the retraction and expansion of the lower limb to be performed smoothly so as to avoid injury to the patient; the sole supporting/moving mechanism provides the sole with free movement when the limb is being bent and released so as to avoid undue pressure on the sole, the sliding mechanism being capable of being set at a particular angle with respect to the horizontal plane so as to have the inward bending of the sole within a suitable range of angles.

In summary, what the present invention may achieve may be categorized into three benefits:

(1) increasing the range of motion for the hip joint, knee joint and ankle joint of the paralytic lower limb so as to improve the functionability of the patient's limb;

(2) enhancing the blood circulation of the paralytic limb and the motion in the joints in order to reduce the occurrence of bed sores; and (3) allowing rehabilitation to be conducted without the manual assistance of other persons so as to help recovery of the function of the patient is limb.

DETAILED DESCRIPTION OF THE INVENTION

A preferred embodiment of the present invention will be described in detail as follows with reference to the attached drawings.

Figure 1:
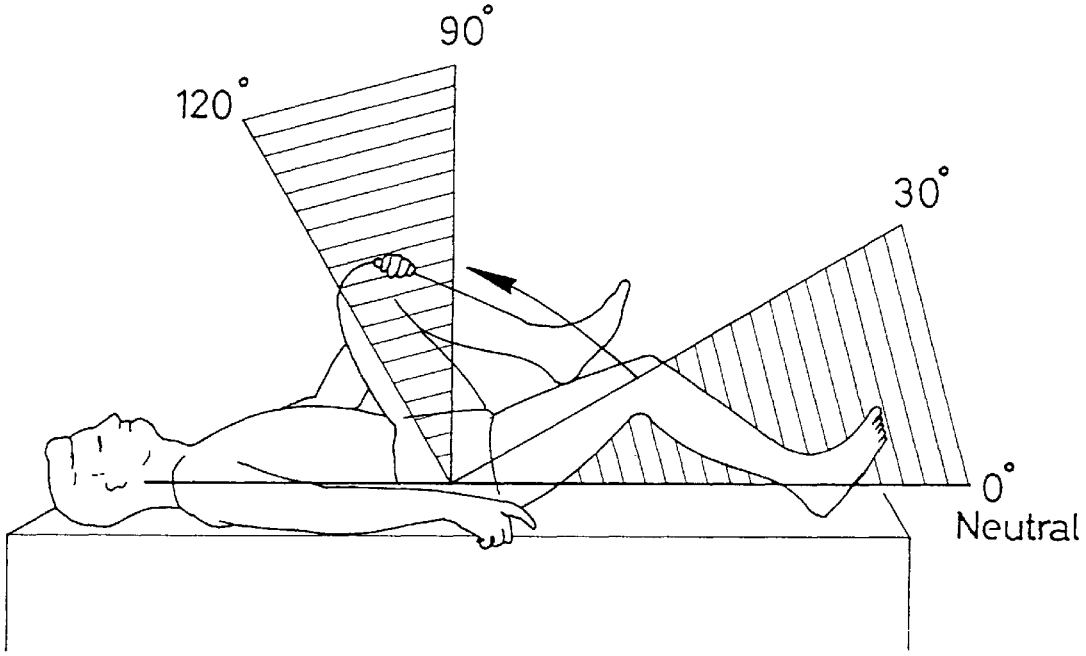
FIG. 1 shows the definition of the hip joint rotation angle adapted in the present invention.
Figure 2:
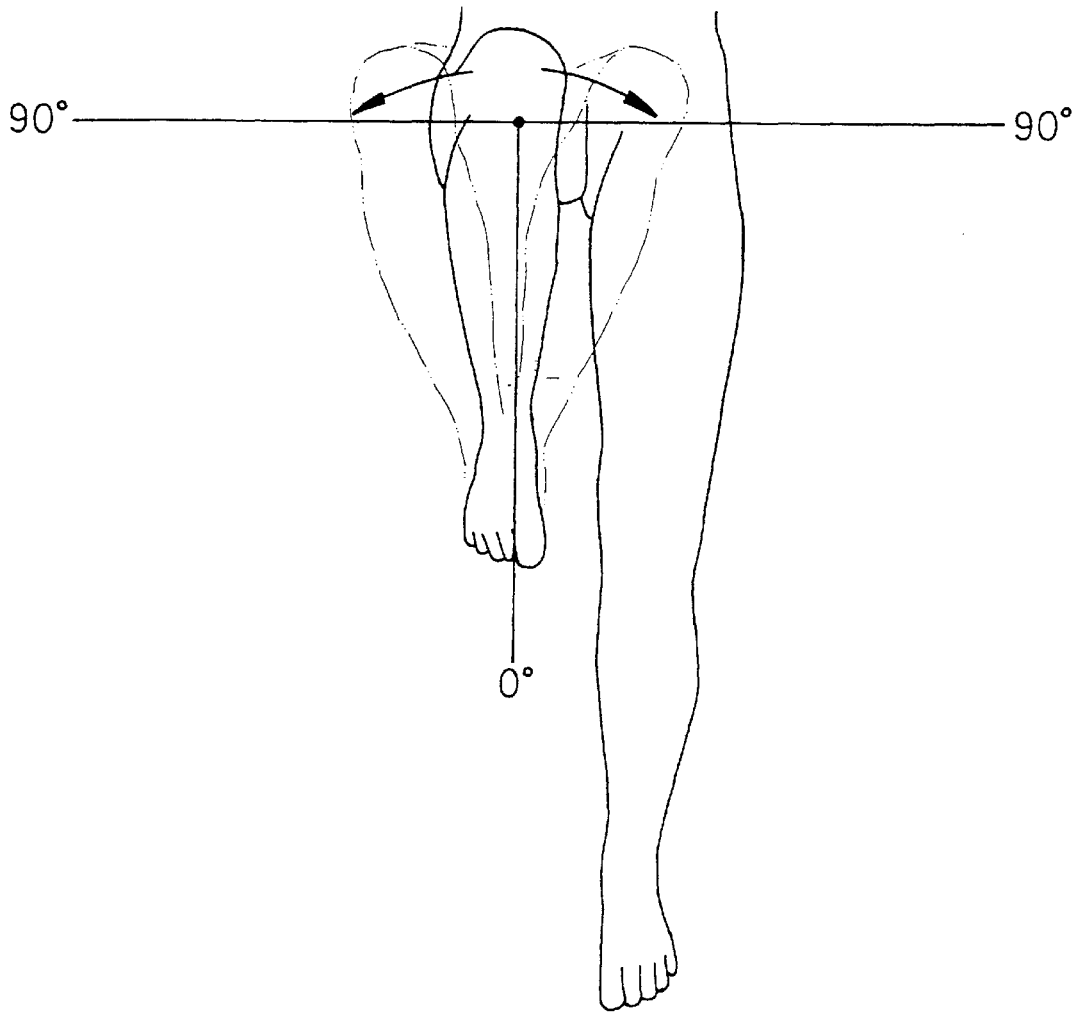
FIG. 2 shows the definition of the thigh inward retraction and outward expansion in the present invention.
Figure 3:
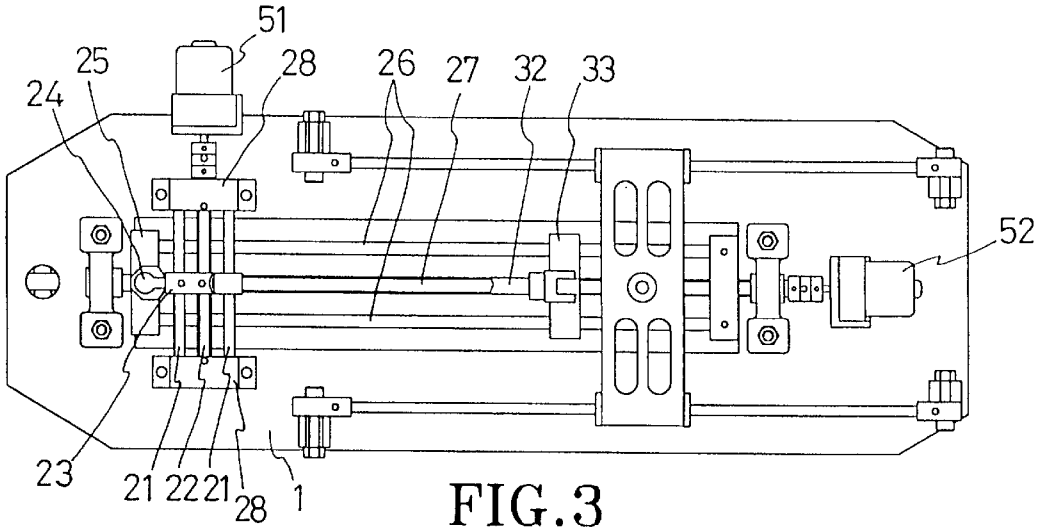
FIG. 3 shows a top view of the inside mechanism assembly of the rehabilitation apparatus of the present invention.
Figure 4:
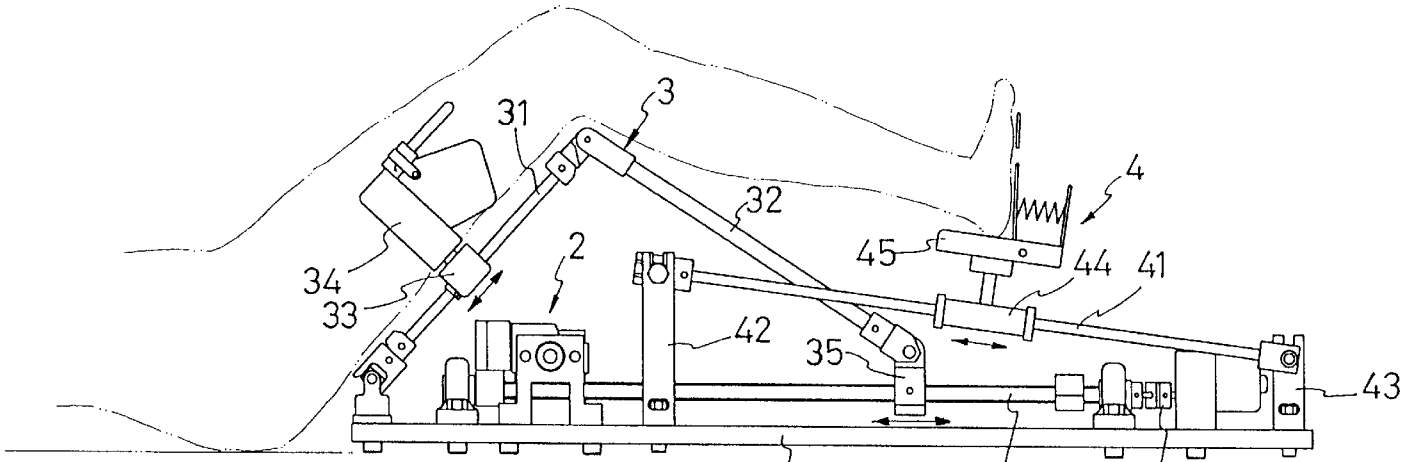
FIG. 4 shows a front view of the inside mechanism assembly of the rehabilitation apparatus of the present invention.

FIGS. 1 and 2 respectively show the definition of the angular range of rotation of the patient's hip joint and the inward retraction and outward expansion of the patient's thigh. The present invention, as shown in FIGS. 3 and 4, is a rehabilitation apparatus which comprises a transversely movable slider mechanism 2, a thigh supporting/moving mechanism 3 and a sole supporting/moving mechanism 4, all theses mechanisms being mounted to a base frame 1. A coordinate system is defined on the base frame 1 in which the Y-axis is in a longitudinal direction and the X-axis in a transverse direction. The Z-axis is defined as a direction normal to the plane defined by the X-axis and the Y-axis.

Figure 6:
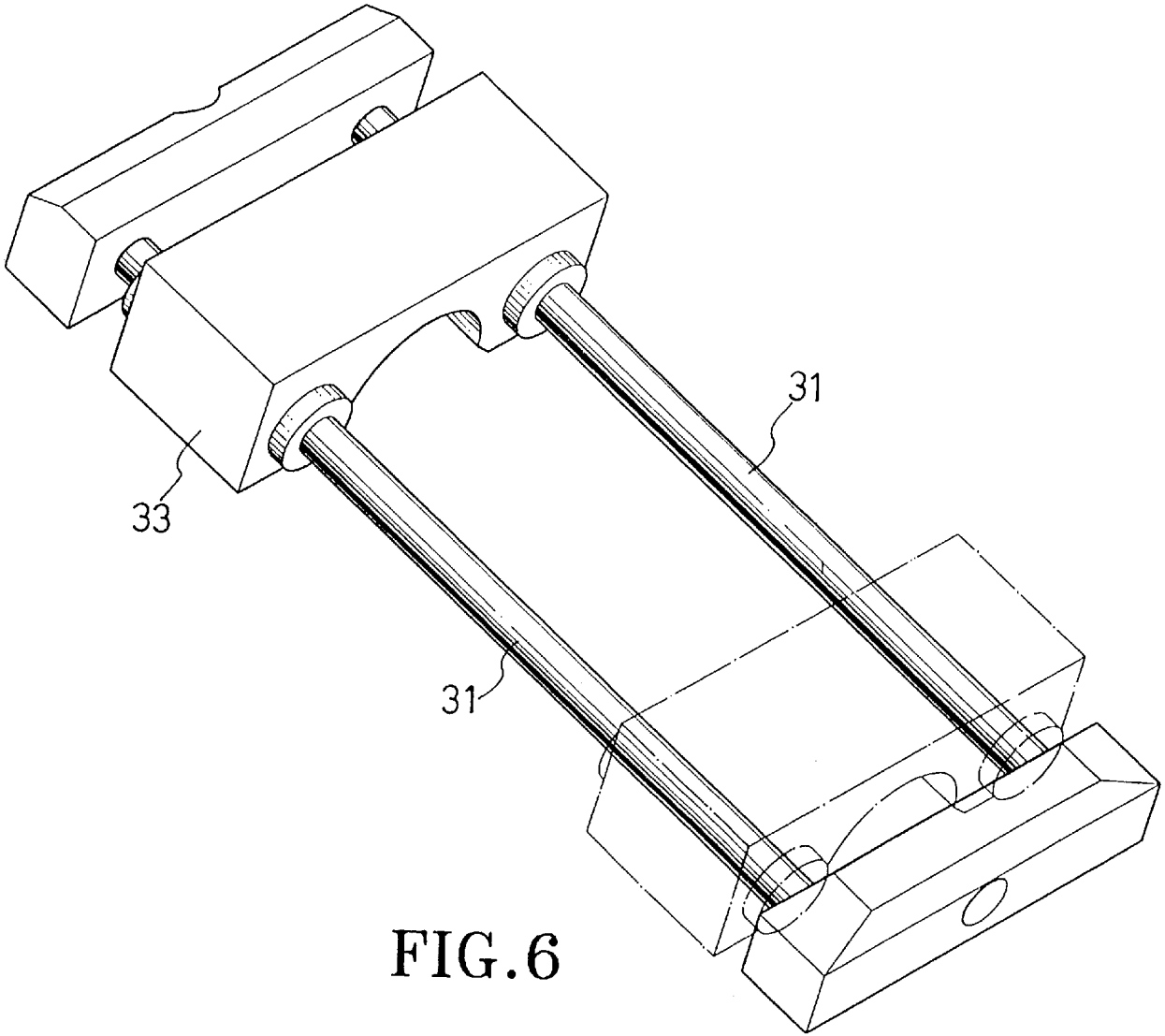
FIG. 6 shows a view of the thigh supporting/moving mechanism of the rehabilitation apparatus of the present invention which supports the thigh.

In the main structure of the rehabilitation apparatus in accordance with the present invention, the thigh supporting/moving mechanism 3 comprises: a first elongated bar 31, a second elongated bar 32, a thigh slider 33, a thigh support 34 and a longitudinal slider 35. When a motor 52 is actuated, a longitudinal screw rod 27, which is coupled to the motor 52 by means of a flexible coupling 53, is driven to rotate and the longitudinal slider 35 moves in the Y direction along two parallel longitudinal slide rails 26 and along the longitudinal screw rod 27. The longitudinal slider 35, together with the first elongated bar 31 and the second elongated bar 32, forms a basic crank-slider mechanism. The first elongated bar 31 changes the angle thereof due to the displacement of the longitudinal slider 35. By means of alternately rotating the screw rod 27 in the forward direction and the reverse direction, a reciprocal motion is induced on the slider 35 which causes the first elongated bar 31 to alternately rotate in forward and reverse direction. In addition, the thigh slider 33 that supports the thigh comprises a sliding mechanism that allows the thigh slider 33 to freely move along the first elongated bar 31. The sliding mechanism of the thigh slider 33 is shown in detail in FIG. 6.

Figure 5:
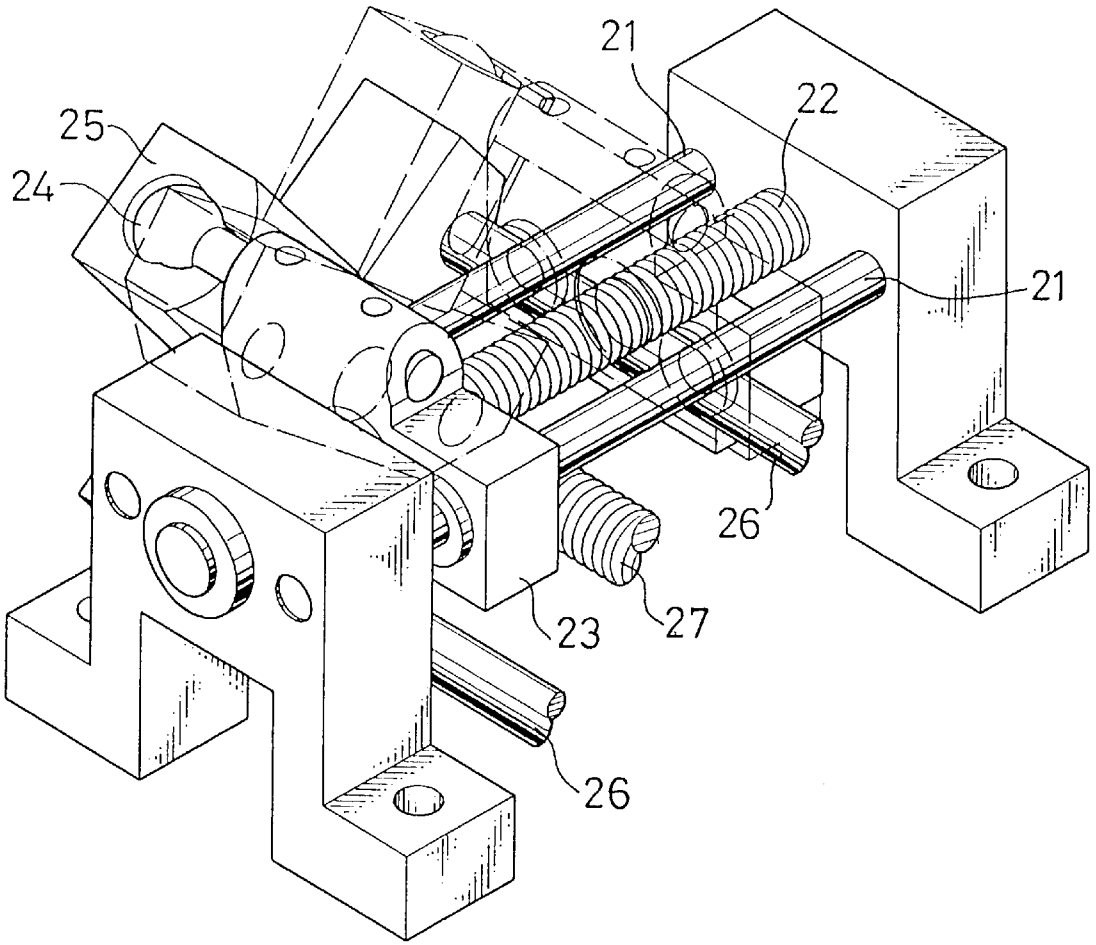
FIG. 5 shows the transversely translating/sliding mechanism of the rehabilitation apparatus of the present invention, which makes use of the transverse screw to drive the transverse slider and, in turn, the longitudinal slider rails to rotate.

The transversely movable slider mechanism 2 comprises: a pair of parallel transverse slide rails 21, a transverse screw rod 22, a transverse slider 23, a spherical joint 24, a spherical joint socket 25, a pair of parallel longitudinal slide rails 26, a longitudinal screw rod 27, a pair of transverse slide rail supports 28, wherein the transverse screw rod 22 is coupled to a motor 51 which, when rotating, drives the transverse screw rod 22 to rotate and thus makes the transverse slider 23 to translate in the X direction along the transverse slide rails 21 and the transverse screw rod 22. The spherical joint 24 is fixed on the transverse slider 23 and coupled to the spherical joint socket 25 which is rotatable around the central axis of the longitudinal screw rod 27. FIG. 5 shows the details of how these elements connect with each other. Further referring to FIGS. 3 and 4, when the transverse slider 23 translates, the spherical joint 24 drives the spherical joint socket 25 to rotate, thus causing the longitudinal slide rails 26 connected thereto to rotate. When the longitudinal slide rails rotate, the longitudinal slider 35 mounted thereon rotates therewith and drives the first and second elongated bars 31 and 32 to rotate.

Figure 7:
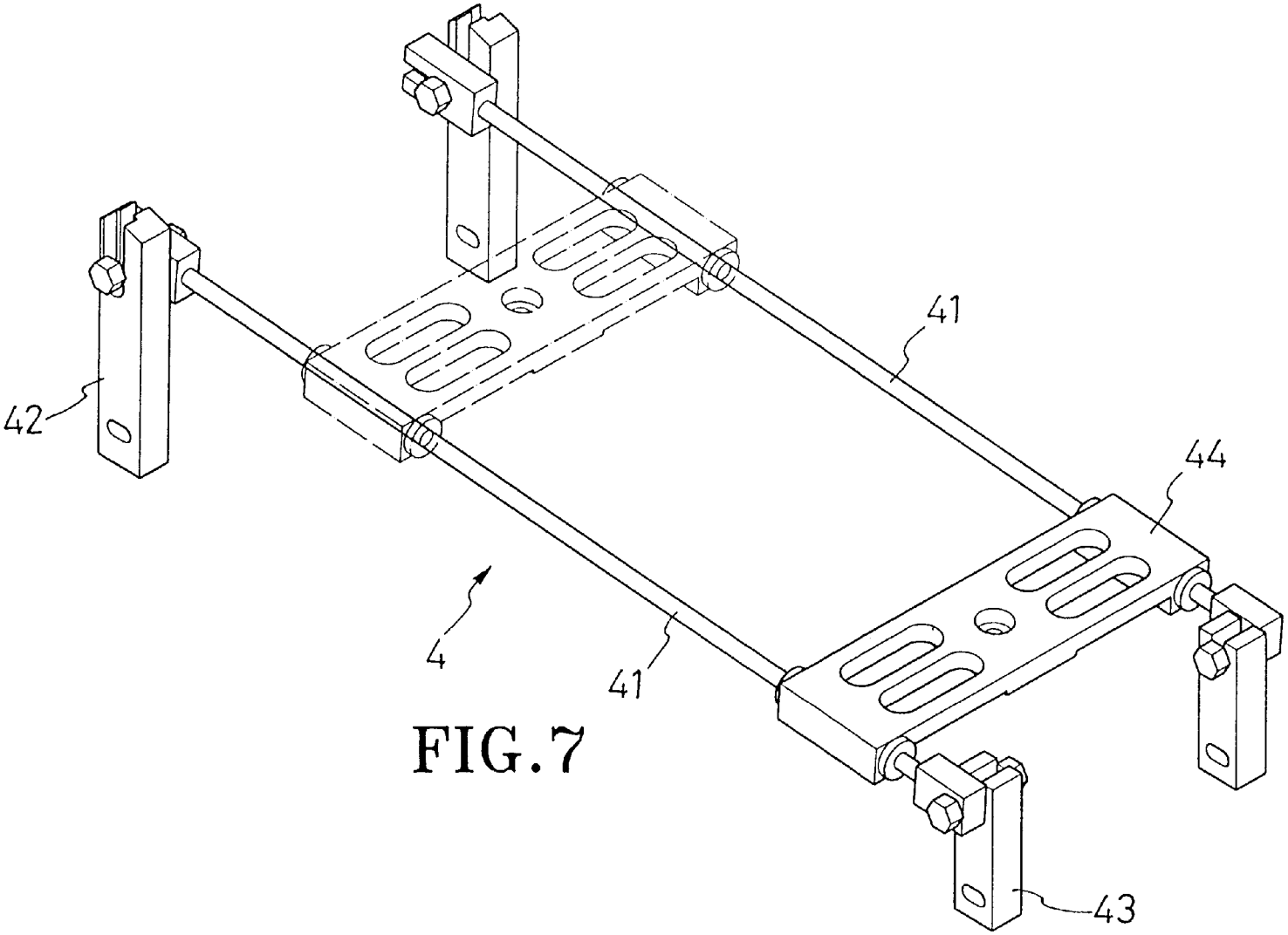
FIG. 7 shows a view of the sole supporting/moving mechanism of the rehabilitation apparatus of the present invention which supports the sole.
Figure 10:
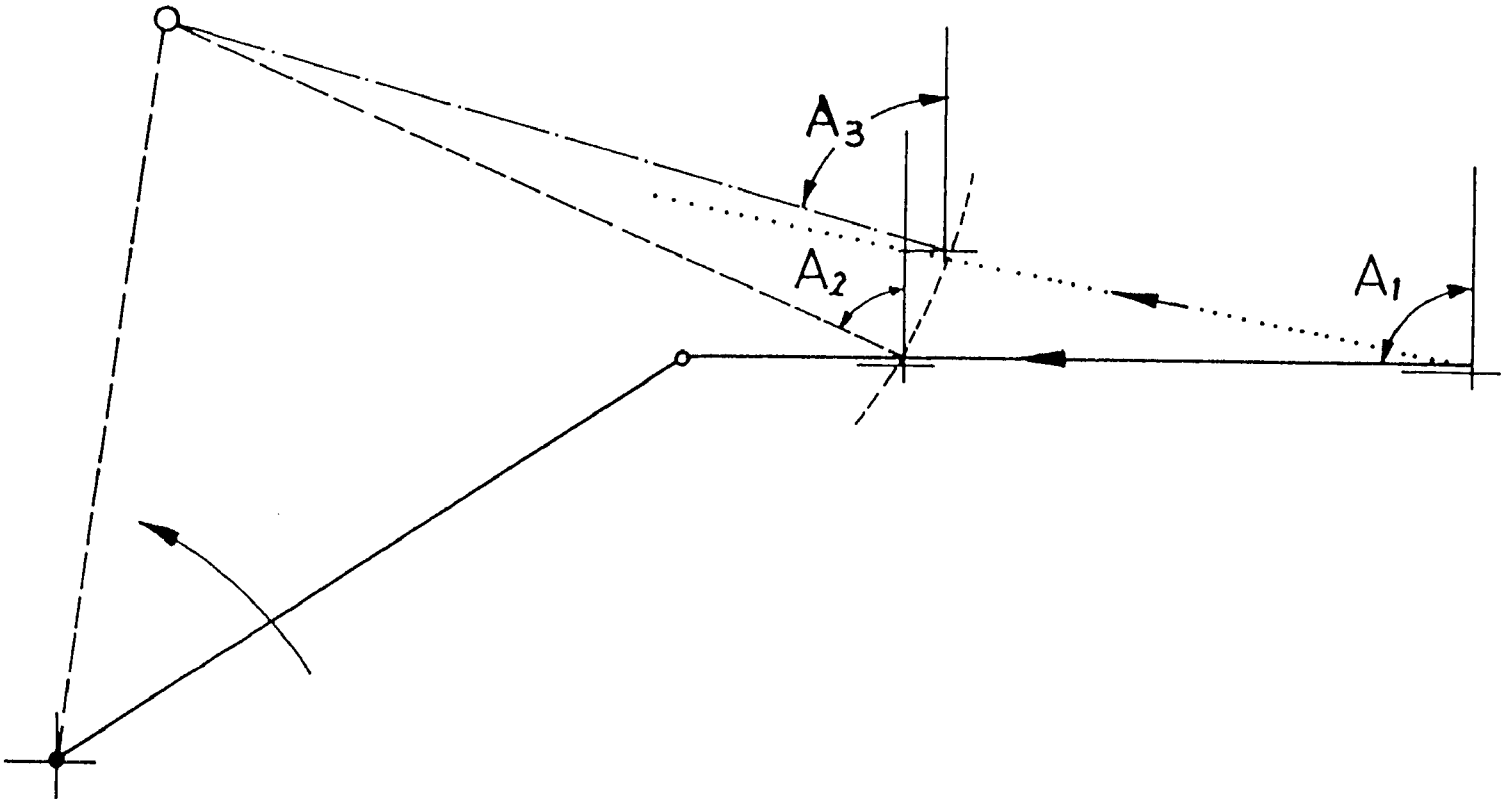
FIG. 10 shows the relative positions of the thigh, shank and sole when the hip joint is rotated upward.

Since the length of the leg shank may vary from person to person, a sole supporting/moving mechanism 4 is particularly provided to accommodate the variance in the length of patients' shank in the present invention. A sole support 45 which is provided to hold and support the sole is mounted on two particularly-designed, inclined slide rails 41 which are parallel to each other, as shown in FIG. 7, wherein the inclined sliding rails 41 have an inclination of 12°to 18°, preferably about 15°. The inclination serves to prevent injury to the ankle caused by excessive force acting upon the sole when the hip joint is rotated upward. Referring to FIGS. 4 and 10, when the thigh, the shank and the sole are placed in the initial starting position (namely, before the thigh is rotated), an included angle between the shank and the sole is A1 which is substantially equal to 90° at this position. When the hip joint begins to rotate upward the included angle between the shank and the sole is A2, if horizontal sliding rails are used to guide the sole support 45. On the other hand, the included angle A3 would be greater than A2 as shown in the drawings if the slide rails are designed to be inclined as described above. The smaller the included angle, the greater the pressure acting upon the sole and the risk of the patient's being injured and the patient's feeling pain will increase. Thus, a suitable inclination is necessary for the design of the slide rails. Furthermore, if the inclination is 15°, then when the hip joint is rotated 90°, the included angle A3 would substantially be equal to 85°. Namely, the sole is subject to the action of a small angle (5°–15°) which provides a small amount of passive exercise to the ankle joint. This helps alleviate the stiffness of the ankle joint. In other words, the feature of the sole supporting/moving mechanism 4 is to accommodate variance in the lengths of shanks in order to protect the ankle joint from being hurt and also offers a small angle of reciprocative motion to the ankle joint.

As shown in FIG. 4, while using the rehabilitation apparatus of the present invention, the patient is first laid down on the apparatus and the thigh to be rehabilitated is placed on the thigh support 34 of the thigh slider 33 and the sole on the sole support 45 and tightly fastened thereon. The rehabilitation apparatus is first operated at a low speed. Once it is inspected and found to have no problems, then the rehabilitation apparatus is switched to a normal speed.

Figure 8:
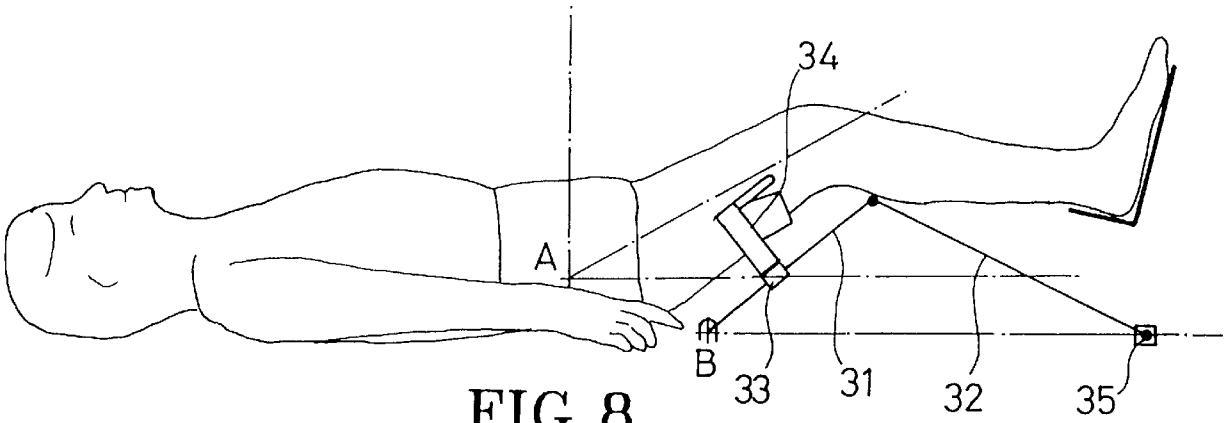
FIG. 8 shows the position of the thigh slider of the rehabilitation apparatus of the present invention when the leg extends.
Figure 9:
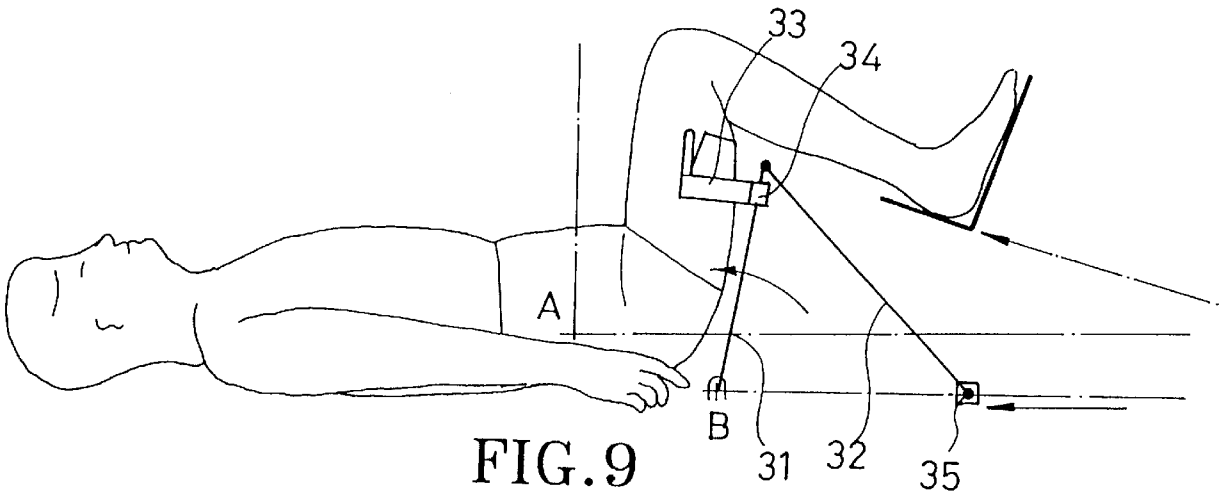
FIG. 9 shows the position of the thigh slider of the rehabilitation apparatus of the present invention when the leg bends.

When the hip joint is rotated up and down and swung outward/inward, the above described motion induces an upward and/or downward force on the thigh and may cause pain to the patient and may even lead to a second injury. To avoid such a problem, the thigh slider 33 that supports the thigh comprises a sliding mechanism as shown in FIGS. 8, 9 and 4. When the hip joint is rotated, it is observed that the thigh slider 33 is also upwardly movable with respect to the first elongated bar 31. This not only releases the force that has been applied to the thigh, but also provides an adjustment device which provides a proper adjustment on the basis of the patient's thigh length.

A major feature of the present invention is that besides turning on the motor 52 to perform bending motion of the lower limb of the patient, turning on the other motor 51 would cause the thigh supporting/moving mechanism 3 to rotate in a small range so as to cause the hip joint of the patient to rotate an inward retraction and outward expansion motion of the thigh shown in FIG. 2. A practical test reveals that the rehabilitation apparatus of the present invention allows the hip joint of the patient to move within a maximum rotation angle of 90°–100° and an inward retraction and outward expansion angle of up to 30°–35° which is suitable for patients of different heights and allows for three different motions of the human body, including hip rotation, thigh inward retraction/outward expansion and small angle ankle pressing motion. No second injury will likely occur to the patient.

In conclusion, the rehabilitation apparatus of the present invention comprises a novel and unique design of a mechanism which has been tested a number of times and for which excellent results have been obtained. Clearly, the apparatus of the present invention has value in the area of medical rehabilitation.

After having been described in detail and illustrated with respect to the preferred embodiment, the structure and feature of the present invention will become apparent. However, it should be noted that the preferred embodiment provides and demonstrates only the best mode for carrying out the present invention. This is not intended to limit the scope of the present invention and any other modification and variation that are made without departing from the spirit of the present invention is considered within the scope to be protected of the invention.

We claim:

1. A paralytic lower limb rehabilitation apparatus comprising:

a base frame having a longitudinal axis Y, the base frame being firmly placed on a flat surface;

a transversely movable slider mechanism, which comprises a transverse screw rod, a pair of transverse slide rails, a transverse slider, a spherical joint, a spherical joint socket, a pair of longitudinal slide rails and a longitudinal screw rod, wherein the pair of transverse slide rails are perpendicular to the longitudinal axis Y and fixed to the base frame at a position in the proximity of a front end of the base frame, the transverse screw rod being located between the pair of transverse slide rails, the transverse slider being driveable by the transverse screw rod to slide along the pair of transverse slide rails, the transverse slider having the spherical joint mounted on a front end thereof to engage the spherical joint socket to allow the spherical joint to rotate with respect to the spherical joint socket and to slide up and down, the spherical joint socket being connected to one end of the pair of longitudinal slide rails, the longitudinal slide rails having a second end fixed to the base frame, the long screw rod is mounted between the slide rails;

a thigh supporting/moving mechanism arranged on a forepart of the base frame, comprising a first and a second elongated bars, and a longitudinal slider, wherein the first elongated bar has an end pivotally connected to the base frame and a second end pivotally connected to one end of the second elongated bar, the second elongated bar having a second end pivotally connected to the longitudinal slider which is movable along the longitudinal slide rails;

a sole supporting/moving mechanism arranged on a rear half of the base frame, comprising a pair of slide rails and a sole slider, the slide rails having their front and rear ends fixed to the base frame, the sole slider being freely and slidably reciprocated along the slide rails.

2. The paralytic lower limb rehabilitation apparatus as claimed in claim 1, wherein the transverse screw rod and the longitudinal screw rod of the transverse movable slider mechanism are driven to rotate by motors.

3. The paralytic lower limb rehabilitation apparatus as claimed in claim 1, wherein the transverse slider is movable along a distance to have the spherical joint socket rotate 35° in both the clockwise and counter-clockwise direction.

4. The paralytic lower limb rehabilitation apparatus as claimed in claim 1, wherein the slide rails of the sole supporting/moving mechanism with respect to the horizontal plane have an inclination angle range of between 12°–18°.

5. The paralytic lower limb rehabilitation apparatus as claimed in claim 1, wherein the thigh supporting/moving mechanism further comprises a thigh support that supports the thigh and is free to slide along the first elongated bar.

6. The paralytic lower limb rehabilitation apparatus as claimed in claim 2, wherein the longitudinal screw rod is connected to the motor by means of a flexible coupling.

7. The paralytic lower limb rehabilitation apparatus as claimed in claim 4, wherein the inclination angle is configured so that the resulted inward bending of the sole is within the range of 5°–15°.

* * * * *

UNITED STATES PATENT AND TRADEMARK OFFICE

CERTIFICATE OF CORRECTION

PATENT NO. : 5,901,581

DATED : May 11, 1999

INVENTOR(S) : Jia-Wine Chen; Ann-Shing Chang; Yeu-Shuun Kou

It is certified that error appears in the above-identified patent and that said Letters Patent is hereby corrected as shown below:

On the title page, item

[73] Assignee: the following should be inserted:

—Far Eastern Memorial Hospital, Taipei Hsien, Taiwan

Yiu–Tong CHU, Taipei, Taiwan—

Signed and Sealed this

Twenty-second Day of August, 2000

*Attest:*

Q. TODD DICKINSON

*Attesting Officer*

*Director of Patents and Trademarks*